US007365293B2

(12) United States Patent
Cho

(10) Patent No.: US 7,365,293 B2
(45) Date of Patent: Apr. 29, 2008

(54) WALL-MOUNTING TYPE MICROWAVE OVEN HAVING A LAMP SUPPORTER

(75) Inventor: Sung-wook Cho, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 37 days.

(21) Appl. No.: 11/134,273

(22) Filed: May 23, 2005

(65) Prior Publication Data

US 2006/0027574 A1 Feb. 9, 2006

(30) Foreign Application Priority Data

Aug. 4, 2004 (KR) ..... 10-2004-0061351

(51) Int. Cl.
*H05B 6/80* (2006.01)
*F24C 15/20* (2006.01)

(52) U.S. Cl. ..... 219/758; 219/756; 362/92

(58) Field of Classification Search ..... 219/758, 219/756; 362/92, 94; 126/275 E, 273 A
See application file for complete search history.

(56) References Cited

U.S. PATENT DOCUMENTS

| | | | | |
|---|---|---|---|---|
| 5,032,956 | A * | 7/1991 | Park | 362/85 |
| 2003/0024925 | A1 | 2/2003 | Graves et al. | |
| 2003/0209963 | A1 | 11/2003 | Altgilbers et al. | |
| 2003/0226842 | A1 | 12/2003 | Lee | |
| 2004/0000548 | A1 | 1/2004 | Shin | |
| 2004/0000549 | A1 | 1/2004 | Lee et al. | |

FOREIGN PATENT DOCUMENTS

| | | |
|---|---|---|
| JP | 62-135023 | 8/1987 |
| JP | 2-52202 | 4/1990 |
| KR | 1993-20096 | 9/1993 |
| KR | 1998-59313 | 10/1998 |
| KR | 2001-26308 | 4/2001 |
| KR | 20-232521 | 9/2001 |
| KR | 20-232525 | 9/2001 |
| KR | 2002-72159 | 9/2002 |
| KR | 2003-0094838 | 12/2003 |
| KR | 2003-0096821 | 12/2003 |
| KR | 2004-2169 | 1/2004 |

OTHER PUBLICATIONS

European Search Report for corresponding EP Application No. 05 25 4802 dated Nov. 16, 2005.
Korean Office Action for corresponding Korean Application No. 10-2004-0061351 dated Feb. 27, 2006.
Japanese Office Action for corresponding Japanese Patent Application No. 2005-224610 dated May 22, 2007.

* cited by examiner

*Primary Examiner*—Philip H. Leung
(74) *Attorney, Agent, or Firm*—Staas & Halsey LLP

(57) ABSTRACT

The present invention relates to a wall-mounting type microwave oven including a main body, a bottom plate provided on a bottom portion of the main body and having an opening, and a lamp supporter to support a lamp provided in the opening. The bottom plate being integrally formed with the lamp supporter to support the lamp. Thus, the lamp installation structure is simplified and the number of components is decreased.

10 Claims, 5 Drawing Sheets

WALL-MOUNTING TYPE MICROWAVE OVEN HAVING A LAMP SUPPORTER

CROSS-REFERENCE TO RELATED APPLICATIONS

This application claims the benefit of Korean Patent Application No. 2004-0061351, filed on Aug. 4, 2004, in the Korean Intellectual Property Office, the disclosure of which is incorporated herein by reference.

BACKGROUND OF THE INVENTION

1. Field of the Invention

The present invention relates to a wall-mounting type microwave oven, and more particularly, to a wall-mounting type microwave oven having a lamp installation structure.

2. Description of the Related Art

Generally, a wall-mounting type microwave oven is placed above a cooking apparatus such as a gas range, a gas oven range or the like, and includes a discharging unit to discharge smoke and smell as well as a basic cooking unit. Such a wall-mounting type microwave oven having a lamp at a bottom portion thereof to illuminate the cooking apparatus such as the gas range or the like, so that a user can easily use the cooking apparatus for cooking without a separate illuminator.

A conventional wall-mounting type microwave oven as shown in FIG. 1, includes a lamp installation structure including a bottom plate 2 having an opening 2*a*, a glass 3 provided in the opening 2*a* of the bottom plate 2, a glass holder 4 coupled to the opening 2*a* of the bottom plate 2 and supporting the glass 3, a lamp 5 disposed above the glass 3 and emitting light downward and a lamp supporting cover 6 detachably coupled to an upper surface of the bottom plate 2 and supporting the lamp 5. The lamp 5 is coupled to the lamp supporting cover 6 by a coupling means 7 such as a screw.

However, in the conventional wall-mounting type microwave oven, the lamp supporting cover 6 and the coupling means 7 are needed to support the lamp 5, therefore, the number of components required and production costs increase and an assembling process thereof is complicated.

For example, there is a lamp installation structure of a wall-mounting type microwave oven, disclosed in Korean Utility Model No. 2000-0037317, wherein the lamp is supported by a separate lamp bracket.

SUMMARY OF THE INVENTION

Accordingly, it is an aspect of the present invention to provide a wall-mounting type microwave oven, in which a lamp installation structure is simplified and the number of components required is decreased.

Additional aspects and/or advantages of the invention will be set forth in part in the description which follows and, in part, will be obvious from the description, or may be learned by practice of the invention.

The foregoing and/or other aspects of the present invention are achieved by providing a wall-mounting type microwave oven including a main body, a bottom plate provided on a bottom portion of the main body and having an opening, and a lamp supporter to support a lamp, wherein the bottom plate is integrally formed with the lamp supporter to support the lamp.

The lamp supporter includes a lamp accommodating portion to accommodate a socket portion of the lamp, and lamp coupling portions to be coupled with a flange portion, and formed at opposite sides of the lamp accommodating portion.

The wall-mounting type microwave oven further includes a reflecting plate integrally formed with the bottom plate at one side of the opening of the bottom plate.

The reflecting plate is curved toward the lamp to reflect light emitted from the lamp.

It is another aspect of the present invention to provide a wall-mounting type microwave oven including a main body, a bottom plate provided on a bottom portion of the main body and having an opening, and a reflecting plate reflecting light emitted from a lamp, wherein the bottom plate is integrally formed with the reflecting plate.

The reflecting plate is curved toward the lamp to reflect the light emitted from the lamp.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
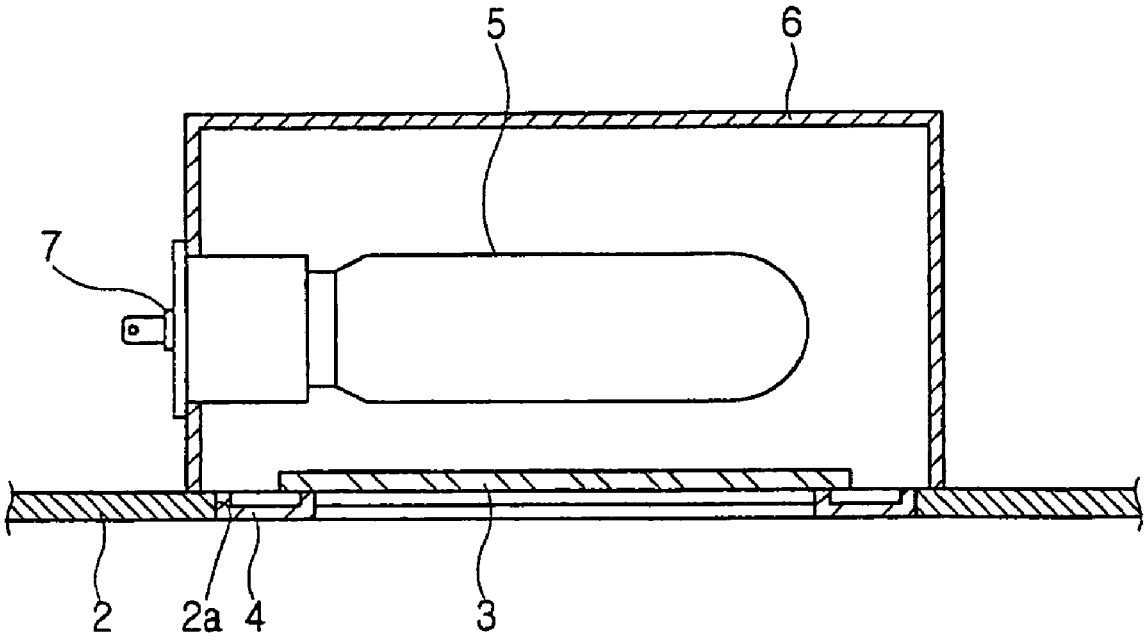
FIG. 1 PRIOR ART
FIG. 1 is a sectional view of a lamp installation structure in a conventional wall-mounting type microwave oven.

Reference will now be made in detail to the embodiments of the present invention, examples of which are illustrated in the accompanying drawings, wherein like reference numerals refer to like elements throughout. The embodiments are described below to explain the present invention by referring to the figures.

Figure 2:
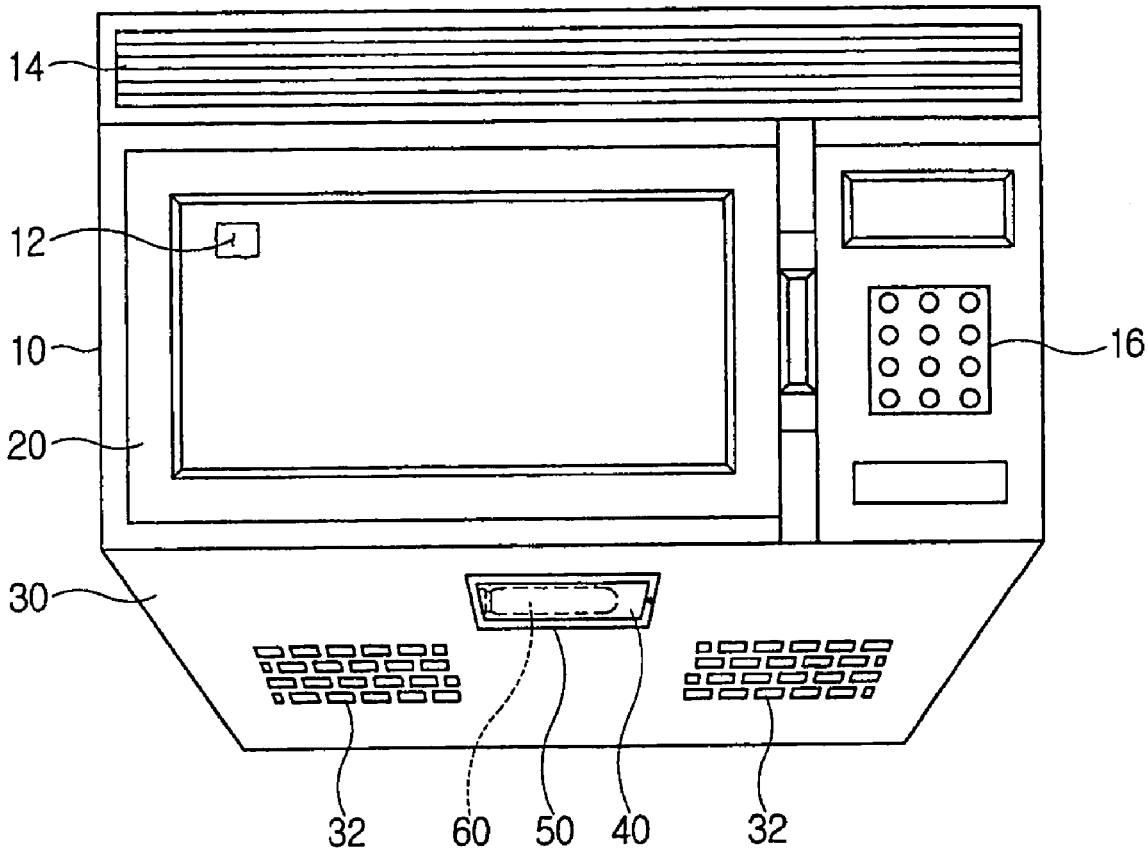
FIG. 2 is a perspective view of a wall-mounting type microwave oven according to an embodiment of the present invention.

In FIG. 2, a wall-mounting type microwave oven including a main body 10, a door 20 provided in a front of the main body 10, a bottom plate 30 having an opening 31 (see FIG. 3), a glass 40 provided in the opening 31 of the bottom plate 30, a glass holder 50 supporting the glass 40, and a lamp 60 disposed above the glass 40.

The main body 10 forms an outer appearance and includes a cooking compartment 12. Further, on an upper front portion of the main body 10 is provided a vent grill 14 forming a passage to allow air to move in and out, and on a side front portion thereof is provided a control panel 16.

The door 20 is rotatably connected to the main body 10 and selectively opens and closes the cooking compartment 12.

The bottom plate 30 includes inhale portions 32 at opposite parts thereof, and each of the inhale portions 32 includes a filter (not shown) for cleaning air circulated into the main body 10.

Figure 3:
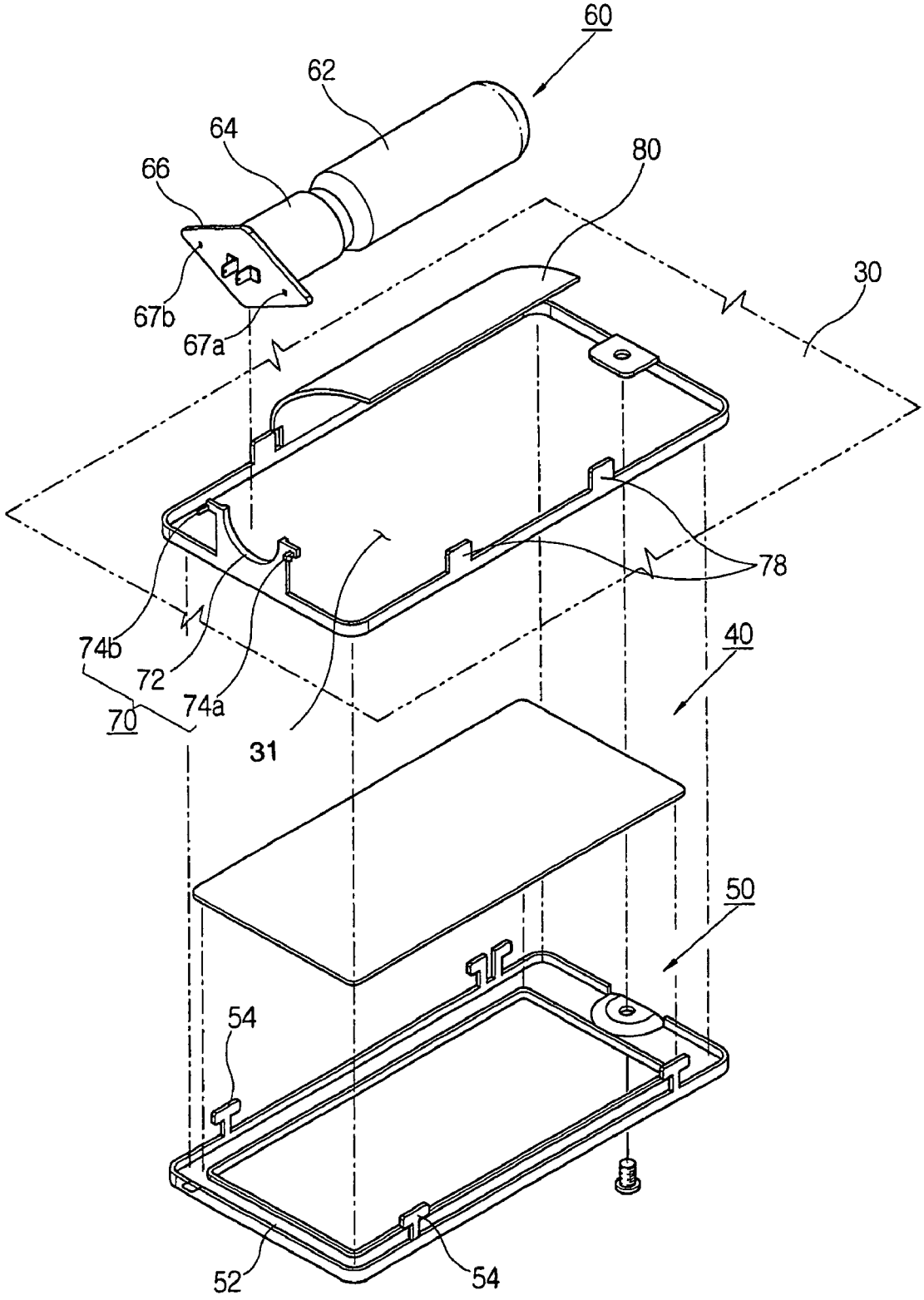
FIG. 3 is an exploded perspective view of a lamp installation structure in the wall-mounting type microwave oven according to an embodiment of the present invention of FIG. 2.
Figure 4:
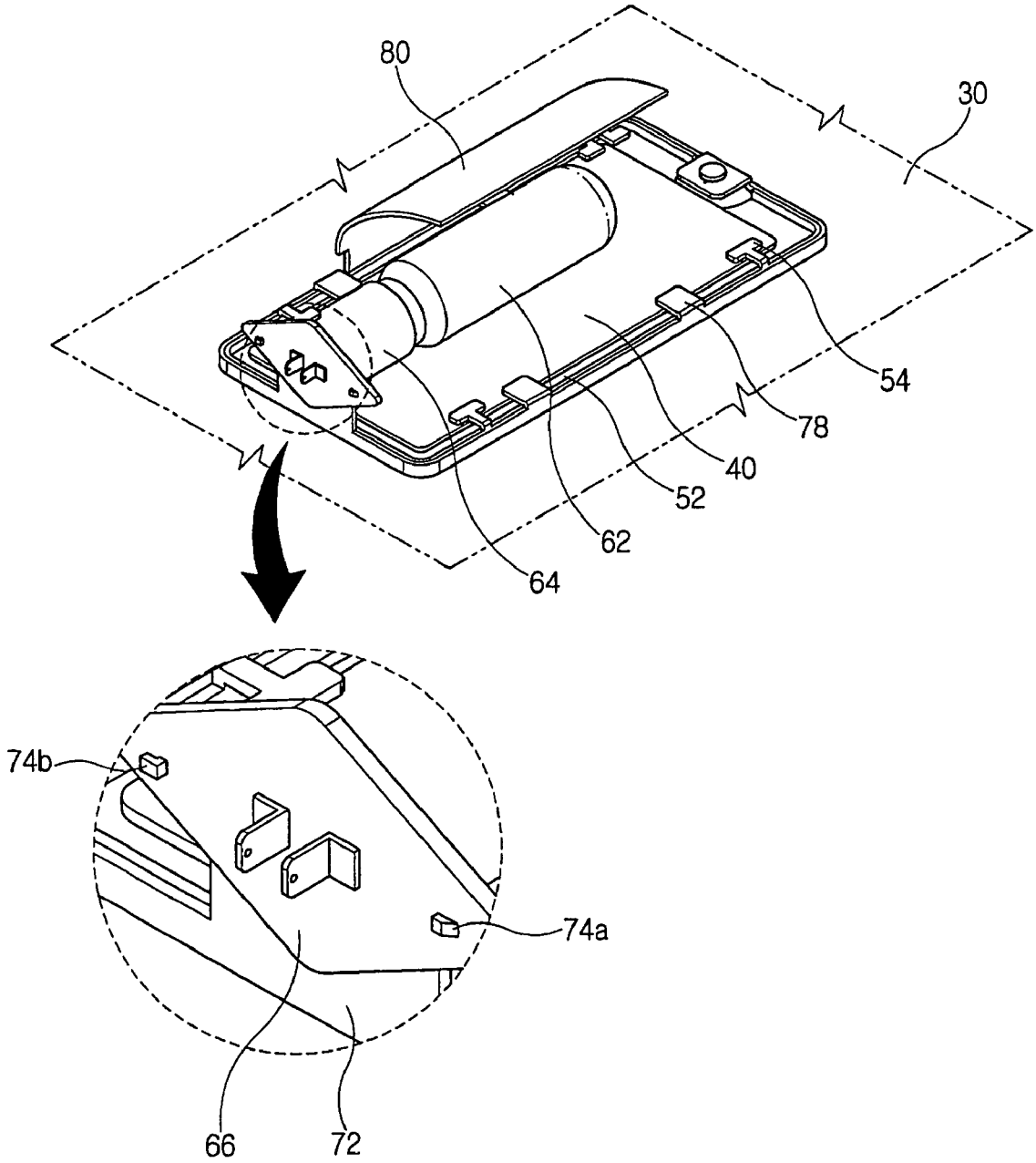
FIG. 4 is an assembled perspective view of the lamp installation structure of FIG. 3.
Figure 5:
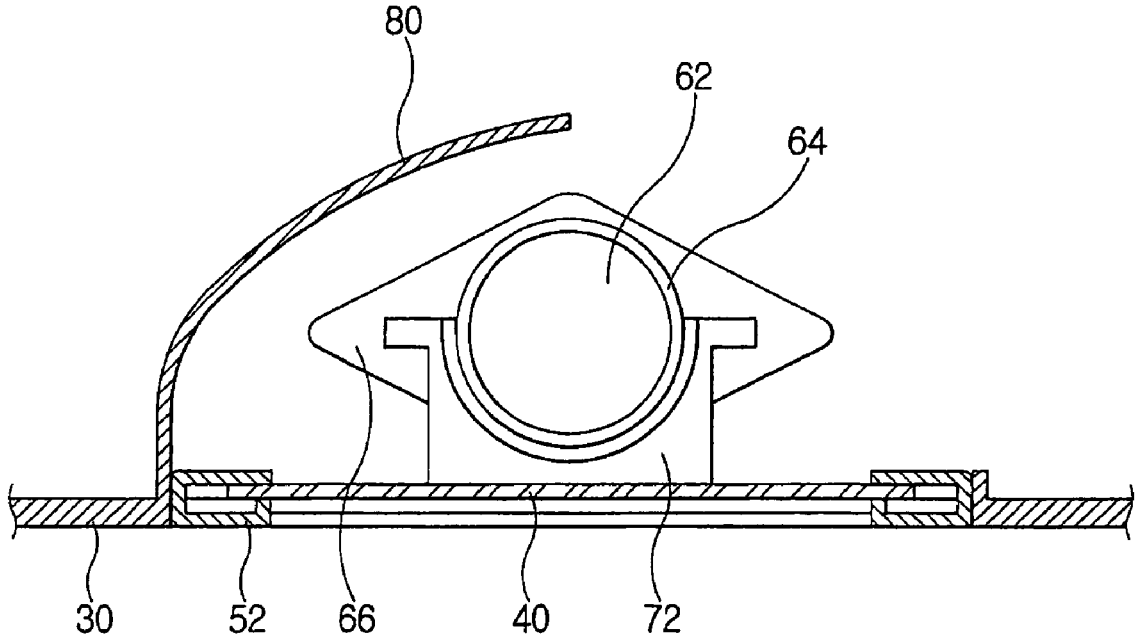
FIG. 5 is a cross section view of the lamp installation structure of FIG. 4.

In FIGS. 3-5, the bottom plate 30 includes a lamp supporter 70 to support the lamp 60, wherein the lamp supporter 70 and the bottom plate 30 are integrally formed as a single body. For example, the lamp supporter 70 is integrally formed with the bottom plate 30 when the bottom plate 30 is formed by a press process or the like. Thus, there is no additional process to assemble the lamp supporter 70.

However, as an alternative, the lamp supporter 70 may have various structures as long as it can stably support the lamp 60 and be integrally formed with the bottom plate 30.

The lamp 60 includes a bulb portion 62, a socket portion 64 electrically connected to the bulb portion 62, and a flange portion 66 extending from the socket portion 64. The flange portion 66 includes first and second coupling holes 67*a*, 67*b*.

The lamp supporter 70 includes a lamp accommodating portion 72 to accommodate the socket portion 64 of the lamp 60, and first and second lamp coupling portions 74*a*, 74*b* formed at opposite sides of the lamp accommodating portion 72 and coupled with the flange portion 66 of the lamp 60. The lamp accommodating portion 72 is of a semicircular groove shape. Further, the first lamp coupling portion 74*a* is hooked with the first coupling hole 67*a* formed at a first side of the flange portion 66 of the lamp 60, and the second lamp coupling portion 74*b* is hooked with the second coupling hole 67*b* formed at a second side of the first portion 66.

The glass 40 allows light emitted from the lamp 60 supported by the lamp supporter 70 to pass therethrough, and protects the lamp 60 from vapor, foreign materials, etc. due to a cooking apparatus placed under the wall-mounting type microwave oven. The glass 40 is of a tempered glass material, and may be replaced with a material excellent in durability and transparency.

The glass holder 50 is coupled with the opening 31 of the bottom plate 30. The glass holder 50 includes a glass seating portion 52 on which the glass 40 is seated, and a plurality of glass supporting portions 54 integrally formed with the glass seating portion 52 and supporting the glass 40. The glass seating portion 52 includes an opening to expose the glass 40 to the outside. Further, each glass supporting portion 54 is bent so that the glass 40 is seated on the glass seating portion 52, thereby contact-supporting an upper surface of the glass 40.

The bottom plate 30 includes a reflecting plate 80 at one side thereof to reflect the light emitted from the lamp 60 toward the glass 40. Further, the reflecting plate 80 is integrally formed with the bottom plate 30 and is curved along the lamp 60, thereby reflecting the light emitted from the lamp 60 toward the glass 40.

The reflecting plate 80 is integrally formed with the bottom plate 30 when the bottom plate 30 is formed by a press process or the like, so that a separate assembling process is not required. The reflecting plate 80 may have various structures and materials as long as it can enhance the illuminating efficiency of the lamp 60.

Here, supporting pieces 78 are provided to further support the glass 40, wherein the supporting pieces 78 are also integrally formed with the bottom plate 30 when the bottom plate 30 is formed by a press process or the like.

As described above, the present invention provides a wall-mounting type microwave oven, in which a lamp supporter and a bottom plate are integrally formed as a single body, so that a lamp installation structure thereof is simplified, thereby decreasing an assembling process.

Further, the number of components due to the lamp installation structure is decreased, thereby a reducing production cost.

Although a few embodiments of the present invention have been shown and described, it will be appreciated by those skilled in the art that changes may be made in these embodiments without departing from the principles and spirit of the invention, the scope of which is defined in the claims and their equivalents.

What is claimed is:

1. A wall-mounting type microwave oven comprising:

a main body;

a bottom plate provided on a bottom portion of the main body and having an opening;

a lamp supporter to support a lamp provided in the opening of the bottom plate, wherein the bottom plate is integrally formed with the lamp supporter as a single body to support the lamp without the need for additional couplers, the lamp supporter including a lamp accommodating portion with first and second lamp coupling portions;

a lamp having a flange portion with first and second coupling holes, wherein the flange portion of the lamp is secured to the lamp accommodating portion by hooking the first lamp coupling portion with the first coupling hole formed at a first side of the flange portion and hooking the second lamp coupling portion with the second coupling hole formed at a second side of the flange portion, such that a length of the lamp is substantially parallel to the opening; and a reflecting plate to reflect light emitted from the lamp provided in the opening, wherein the bottom plate is integrally formed with the reflecting plate as a single body on only one side thereof and curved along the length of the lamp.

2. The wall-mounting type microwave oven according to claim 1, wherein the reflecting plate is curved toward the lamp to reflect light emitted from the lamp.

3. The wall-mounting type microwave oven according to claim 1, further comprising:

a glass holder coupled with the opening of the bottom plate on which a glass portion is positioned.

4. The wall-mounting type microwave oven according to claim 3, wherein the glass holder comprises:

a glass seating portion on which the glass portion is seated; and a plurality of glass supporting portions integrally formed with the glass seating portion and supporting the glass portion.

5. The wall-mounting type microwave oven according to claim 4, wherein the glass supporting portions are bent and contact with the glass portion, to maintain a fixed position of the glass portion.

6. The wall-mounting type microwave oven according to claim 5, wherein the bottom plate further comprises supporting pieces integrally formed therewith, wherein the supporting pieces and the glass supporting portions of the glass seating portion together contact with and secure the glass portion seated on the glass seating portion.

7. The wall-mounting type microwave oven according to claim 1, wherein the lamp accommodating portion is of a semicircular groove shape.

8. A wall-mounting type microwave oven comprising:

a main body having a bottom plate having an opening;

a lamp supporter to support a lamp provided in the opening of the bottom plate, the lamp supporter having a lamp accommodating portion to accommodate a socket portion of the lamp; and a reflecting plate to reflect light emitted from the lamp provided in the opening, the reflecting plate being formed on only one side of the bottom plate and curved along the length of the lamp, wherein the bottom plate, the lamp supporter and the reflecting plate are integrally formed of a single piece of material.

9. The wall-mounting type microwave oven according to claim 8, wherein the single piece of material is a single piece of metal.

10. A wall-mounting type microwave oven comprising:

a main body having a bottom plate provided on a bottom portion of the main body, the bottom plate forming an opening;

means for supporting a lamp provided in the opening using a lamp supporter integrally formed with the bottom plate and not needing additional, external fasteners; and means for reflecting light from the lamp towards the opening using a reflecting plate integrally formed on only one side of the bottom plate and curved along the length of the lamp and not needing additional, external fasteners.

* * * * *